US007403112B2

(12) United States Patent
Kampel et al.

(10) Patent No.: US 7,403,112 B2
(45) Date of Patent: Jul. 22, 2008

(54) SEARCH DEVICE FOR LOCATING A TRANSMITTER, IN PARTICULAR AN AVALANCHE-VICTIM SEARCH DEVICE

(75) Inventors: Gerald Kampel, Hainbuchenstrasse 67, Taufkirchen (DE) 82024; Ingo Zawallich, Unterföhring (DE); Rolf Matzner, Starnberg (DE)

(73) Assignee: Gerald Kampel, Taufkirchen (DE)

( * ) Notice: Subject to any disclaimer, the term of this patent is extended or adjusted under 35 U.S.C. 154(b) by 232 days.

(21) Appl. No.: 11/082,079

(22) Filed: Mar. 16, 2005

(65) Prior Publication Data

US 2005/0231359 A1 Oct. 20, 2005

(30) Foreign Application Priority Data

Mar. 17, 2004 (DE) ..... 10 2004 013 097
Jun. 4, 2004 (DE) ..... 10 2004 027 314

(51) Int. Cl.
*G08B 1/08* (2006.01)

(52) U.S. Cl. ..... 340/539.13; 340/573.1; 455/90.1

(58) Field of Classification Search ..... 340/539.13, 340/551, 539.11, 539.21, 539.23, 573.1; 342/443, 146, 158; 455/90.1
See application file for complete search history.

(56) References Cited

U.S. PATENT DOCUMENTS 6,567,036 B1 * 5/2003 Eckhard ..... 342/22
6,957,593 B1 * 10/2005 Burns ..... 73/866
6,960,996 B2 * 11/2005 Sackl ..... 340/539.11
2002/0169539 A1 * 11/2002 Menard et al. ..... 701/200
2003/0135327 A1 * 7/2003 Levine et al. ..... 701/220

FOREIGN PATENT DOCUMENTS

| | | | |
|---|---|---|---|
| AU | 006 120 | U2 | 4/2003 |
| DE | 40 16 959 | A1 | 12/1990 |
| DE | 195 26 494 | C2 | 1/1997 |
| DE | 298 13 723 | U1 | 11/1998 |
| DE | 299 22 217 | U1 | 3/2000 |
| DE | 199 46 212 | A1 | 4/2000 |
| DE | 199 14 380 | A1 | 10/2000 |
| DE | 100 30 719 | C2 | 1/2002 |
| DE | 101 09 284 | A1 | 3/2003 |
| EP | 0 733 916 | A2 | 9/1996 |
| WO | 99/06798 | | 2/1999 |

* cited by examiner

*Primary Examiner*—Phung T. Nguyen
(74) *Attorney, Agent, or Firm*—Fitch, Even, Tabin & Flannery

(57) ABSTRACT

Search device for locating a transmitter, in particular an avalanche-victim search device (1), such that for scanning a search area the search device (1) is swiveled by a user through a range of search angles that covers the region to be searched, which independently determines the position of an avalanche victim or several such victims in a reliable and economical manner, with a magnetic-field sensor that sends to a signal-processing means sensor signals related to the earth's magnetic field that are then sent on as processed signals to the output unit, and to every search direction there is assigned a fixed search angle relative to the earth's magnetic field, so that at every time it is possible to associate the signal received from a transmitter with a fixed search angle.

40 Claims, 3 Drawing Sheets

SEARCH DEVICE FOR LOCATING A TRANSMITTER, IN PARTICULAR AN AVALANCHE-VICTIM SEARCH DEVICE

The invention relates to a search device with which to locate a transmitter, in particular in order to search for people buried in avalanches, such that to scan an area that is to be searched the search device is swiveled by a user through an angular range that covers the search area.

BACKGROUND OF THE INVENTION

Devices for locating avalanche victims operate with an unmodulated transmission signal at 457 kHz. The normal procedure for skiers is that all the members of a group switch their devices to transmitter operation. Then if part of the group is caught in an avalanche, the others switch their devices to receive mode and try to locate the buried ones on the basis of the signals their devices are transmitting.

The transmission signal is pulsed at a frequency of about one hertz. The transmission time at the frequency of 457 kHz, the so-called duty cycle, is from ten to thirty percent.

For localization by hearing (e.g., maximal/minimal field strength) conventional devices generate an audible search tone at a frequency of about 2 kHz, by down-mixing of the 457-Hz transmission signal. Because the built-in antenna has a pronounced directional characteristic, by rotating the receiving device and looking for the loudness maximum or minimum it is possible to detect the direction at which the strength of the signal emitted by the buried transmitter is maximal. This technique demands experience and close concentration by the searcher, as well as a low level of ambient noise, especially where long distances are concerned.

To simplify the search even for searchers who have had no previous experience and are in stress situations, devices have been developed with several antennae disposed at right angles to one another. By switching between these antennae, the direction from which the transmitted signal is being received can be determined.

In practice, this method has a number of disadvantages. For one thing, the antennae influence one another even when turned off, so that the reception sensitivity of the device deteriorates. In particular, it is almost impossible to determine directionality in the case of large distances, over 50 meters, so that the directional indications thus obtained are not usable. Another disadvantage is that this technique is extremely sensitive to disturbances, so that the indicated direction varies widely when conditions are not optimal.

A particular challenge is presented to the searcher when the signals sent by several buried transmitters are being received simultaneously. In this case an extraordinary amount of practice as well as a complicated search strategy are needed in order to localize the sender.

SUMMARY OF THE INVENTION

Hence it is the objective of the invention to disclose a search device of this generic kind that independently specifies the position of at least one buried sender, in a reliable and economical manner.

This objective is achieved by a search device having a search antenna to receive signals being sent out by a transmitter from momentary search directions, a signal-processing means to generate processed signals from the transmitter signals, and an output unit to which the processed signals are sent and which sends to the user result signals that represent the processed signals. Further, a magnetic-field sensor that outputs to the signal-processing means sensor signals regarding the earth's magnetic field. These signals are sent on as processed signals to the output unit and assign to each search direction a fixed search angle ($\phi$) relative to the earth's magnetic field ($\mu$). This objective is also achieved by a localization procedure. The localization procedure includes the search device being swiveled by a user through a range of search angles that covers the search region. Transmitter signals are sent out by the transmitter are received from momentary search directions by a search antenna of the search device. Processed signals are generated from the transmitter signals and result signals that represent the processed signals are output to the user. Sensor signals related to the earth's magnetic field are displayed to the users as processed signals by way of result signals, and to each search direction there is assigned a fixed search angle ($\phi$) relative to the earth's magnetic field ($\mu$).

A search device for locating (at least) one transmitter, in particular a device to search for transmitters buried in avalanches, which in order to scan an area to be searched is swiveled by a user through an angular range that covers the search area, conventionally comprises the following:

- a search antenna to receive transmitter signals sent out by the transmitter from the momentary direction of search,
- a signal-processing means to generate processed signals from the transmitter signals, and
- an output unit to which the processed signals are sent and which makes available to the user result signals that represent the processed signals.

According to the invention such a search device further comprises a magnetic-field sensor that outputs to the signal-processing means sensor signals related to the earth's magnetic field; these are sent as processed signals to the output unit so that to every search direction there is assigned a fixed search angle relative to the earth's magnetic field.

An essential idea underlying the invention is that a search device capable of solving the above problem would ideally operate like a radar installation and rotate its antenna continually through a certain angular range, e.g. 180 degrees. Because in this case the angle of the antenna at any moment is known, a signal with a certain field strength received at any point in time can be associated with the antennal angle at that time. In practice, of course, such an arrangement cannot be implemented. However, the rotation through 180 degrees can be achieved if the device is held in the hand of the searching person while the latter is walking, and is swiveled toward the left and right, a procedure already involved when search devices according to the state of the art are used. Then the problem is to specify the angle of the device, at any given time, with respect to an external reference system of coordinates.

In principle it is conceivable to obtain information about the momentary search angle by evaluating the signals from acceleration sensors or rotation sensors. In practice, problems regarding the initial value and the constant acceleration due to gravity introduce major errors here.

Information about the search angle could also, in some circumstances, be obtained by evaluating the GPS signal. Difficulties with this approach are the relatively high costs of a GPS receiver and the fact that adequate GPS signals are in general—for rescue purposes—insufficiently available.

In accordance with the invention the earth's magnetic field is employed as such a fixed and permanently available reference coordinate system. Hence it is possible at any time to associate the signal received from a transmitter with a fixed search angle.

In one preferred embodiment of the search device in accordance with the invention the magnetic-field sensor sends three sensor signals regarding the earth's magnetic field to the signal-processing means. Thus it is possible to determine the spatial angle of the device relative to the field lines, by measuring the field-strength components of the earth's magnetic field on three mutually perpendicular axes.

Furthermore, magnetic-field sensors with a precision of 1 degree are available at more favorable prices than a GPS receiver, so that the search device in accordance with the invention can be produced more economically.

In another design inclination sensors are provided to output to the signal-processing means sensor signals that represent the orientation of the search device with respect to a horizontal plane. By employing the signals emitted by the inclination sensors, the signals from the magnetic-field sensors can be advantageously corrected in such a way that the position of the search device relative to the earth's magnetic field can be specified very precisely, and independently of the horizontal position of the search device.

In still other embodiments of the search device in accordance with the invention the signal-processing means is so constructed that from the transmitter signals and the sensor signals it can generate angle signals that represent a reception field strength in dependence on a search angle. By applying signal-processing mechanisms to the angle signal in accordance with the invention, it is possible to determine the location of the transmitter in an especially simple and reliable manner.

In another design, in particular of the embodiment just mentioned, the signal-processing means is constructed to calculate a transmitter search angle, at which the transmitter is located, with reference to the angle signal. As a result, the search device can specify the location of the transmitter, because the distance between transmitter and search device can readily be found by conventional procedures. Therefore it is not necessary to determine the site of the transmitter by hearing. The transmitter search angle can be determined after the search device in accordance with the invention has been swiveled back and forth once or several times, even if the device has already been pointed again in a completely different direction.

In another design of this embodiment the signal-processing means is constructed so as to determine the transmitter search angle from at least two angle signals.

One problem with transmitters used to locate avalanche victims is that the signal sent out by the transmitter is intermittent. Hence during a random swiveling movement it will often happen that the transmitter is in a pause phase at just the time when the search device is being held in the direction of maximal or minimal field strength (during the periods when the transmitter is transmitting). The sequence of angle signals, i.e. the function of the reception field strength over the search angle, will therefore in general be available only in discrete segments. It is thus advantageous for the search device to implement an algorithm for extrapolating a maximum and minimum from the values lying in between. In principle only two arbitrary points in the field-strength curve (i.e., two angle signals) are needed here, if the directional characteristic of the search antenna is known.

For this purpose the two representations (time→search angle) and (time→field strength), obtained as described above for the search angle and as follows for the field strength, are transformed into a single representation (search angle→field strength). In an especially advantageous embodiment of the search device in accordance with the invention the extrapolation or interpolation of the complete curve in the representation (search angle→field strength) is carried out by applying the method of smallest error square. This enables a continual improvement of the estimated field-strength curve over the search angle as additional measured values are acquired.

In other embodiments of the search device in accordance with the invention the output unit is designed for a graphical output of result signals that represent the transmitter search angle, and in particular comprises a display field for graphic display of the transmitter site in the search region. This makes it possible for the transmitter site to be rapidly and intuitively identified by the user.

In other embodiments of the search device in accordance with the invention the signal-processing means comprises a filter correlation unit, designed to detect angle signals by correlating the transmitter signals (received signal or down-mixed received signal) with prespecified pattern or filter signals. As a result it becomes possible to detect weak signals from a transmitter that is situated, for example, at a great distance from the search device. This corresponds to detecting a signal with known form in a noise background. With the filter correlation unit it is possible, for instance, to implement a so-called matched-filter mechanism so as to carry out a cross-correlation between the sought and the received signal.

In another design of this embodiment the filter correlation unit is constructed so as to correlate the angle signals with a sinusoidal and with a cosinusoidal filter-signal sequence. In particular in the case of a cosinusoidal filter signal, i.e. when a cosinusoidal transmitter signal is expected, the effort of calculation can be considerably reduced in comparison to a matched-filter method, if the transmitter signal is decomposed into a sine and a cosine component. In this case, instead of cross-correlation, a simple multiplication with the sine and the cosine component of the pattern or filter signal suffices, with subsequent specification of an amount and moving-average filtering.

In further embodiments the signal-processing means of a search device in accordance with the invention comprises an autocorrelation unit, designed to detect periodic components in stored signals by autocorrelation. If the signals from several transmitters are being received, those from the various transmitters can become superimposed and also obliterate one another. However, because two devices always have repetition rates and/or periodicity conditions that differ slightly from one another, in principle it is possible for the signal being received at any time to be ascribed to one or the other transmitter. When the signals from multiple transmitters are superimposed, what results is the sum of several signals that are periodically being turned on and off. Therefore the autocorrelation function is suitable to detect the periodic components of this overall signal. For example, from the measured reception field strengths a threshold-value decision can be used to construct an on/off function, the autocorrelation function of which contains spectral lines at the frequencies that are present. Hence it is possible to separate the signals from several transmitters by providing an autocorrelation unit in the search device.

In other designs of the search device in accordance with the invention a filter correlation unit is included in the circuit after the autocorrelation unit. This measure makes the construction of the search device especially advantageous, because initially all detectable (possibly weak) transmitter signals are identified and then, by simple means, these signals can be assigned to different transmitters.

In other designs the search antenna in the search device in accordance with the invention is a ferrite antenna, preferably with a cosinusoidal directional characteristic. Because of their pronounced directional characteristic, ferrite antennae are especially suitable for localization of a transmitter. A cosinusoidal directional characteristic makes it possible, for example, to construct the above-mentioned filter correlation unit in such a way that the angle signals are correlated with a sinusoidal and with a cosinusoidal filter-signal sequence.

In other designs of the invention the search device comprises a signal-producing transmitter, and these transmitter signals are preferably individualized by a transmitter-identification code. This allows group functions to be implemented, so that out of a plurality of transmitters at least one can be identified by its individualized identifier, for instance the one that belongs to the leader of a group of skiers.

In certain additional embodiments of the invention the signal-processing means is designed to generate processing signals that associate a transmitter identifier with a transmitter search angle, in which case a transmitter is designed in such a way that signals sent out by this transmitter can be individualized and hence be distinguished from other transmitters' signals. As a result, the user of the search device in accordance with the invention is provided in an advantageously simple manner with the option of a display in which one of several located transmitters stands out from the others.

A method of localizing a transmitter, in particular the transmitter belonging to an avalanche victim, conventionally comprises the following steps:

- for scanning a search area, the user swivels a search device through a range of search angles that covers the search area,
- signals emitted by the transmitter are received from the momentary search directions by a search antenna on the search device,
- processed signals are generated from the transmitter signals, and
- result signals that represent the processed signals are output to the user.

In accordance with the invention such a method is developed further in such a way that sensor signals related to the earth's magnetic field are displayed to the users as processed signals, in the form of result signals, and to every search direction is assigned a fixed search angle relative to the earth's magnetic field. Thus the earth's magnetic field is utilized as a fixed reference coordinate system, and it is possible at any time to assign a specific search angle to the measured signal received from a transmitter.

In preferred embodiments of the method in accordance with the invention, in order to assign a particular angle to the search direction, field-strength components of the earth's magnetic field are measured in three mutually perpendicular directions. Thus the spatial angle of the device relative to the field lines can be determined.

In other preferred embodiments of the method in accordance with the invention, the inclinations of the search device with respect to the horizontal plane are measured and the sensor signals are correspondingly corrected. Thus the celestial direction can advantageously be precisely determined.

In other embodiments of the method in accordance with the invention angle signals, each of which indicates a reception field strength at a particular search angle, are generated from the transmitter signals and the search direction and search angle assigned thereto. After the angle signals have been generated, it is advantageous to apply signal-processing mechanisms to them, which enables the site of the transmitter to be specified in an especially simple and reliable manner.

In other forms of the method in accordance with the invention a transmitter search angle, i.e. the angle at which the transmitter is situated, is calculated on the basis of the angle signals and a result signal representing the transmitter search angle is produced. This can be used to specify the site of the transmitter, because it is simple to determine the distance between transmitter and search device by conventional procedures. Hence it is not necessary to determine the transmitter site by hearing. The transmitter search angle can be determined after swiveling the search device in accordance with the invention back and forth one or more times, even if the device has already been pointed again in a completely different direction.

In another form of the invention the transmitter search angle is found from at least two, in particular at least three angle signals. In the case of pulsed transmitter signals, during a random swiveling movement it often happens that the transmitter has interrupted transmission at just the time when the search device is being held in the direction of maximal or minimal field strength. The sequence of angle signals, i.e. the function of the reception field strength over the search angle, will therefore in general be available only in discrete segments. It is thus advantageous for the method in accordance with the invention to be such that a maximum and minimum can be extrapolated from the values lying in between. In principle only two arbitrary points in the field-strength curve (i.e., two angle signals) suffice for this purpose, if the directional characteristic of the search antenna is known. For a robust approximation it is advantageous to use at least three angle signals.

In other designs of the above-mentioned embodiment an estimated sequence of angle signals is calculated from the angle signals by the method of smallest error squares, and the transmitter search angle is determined from the maximum of the estimated angle-signal sequence. From the available segmented sequences of angle signals the desired parameters of the entire curve can be estimated by the method of the smallest error square. From this it is possible by simple means to calculate the estimated angle-signal sequence, as has already been explained above.

In other designs of this embodiment, during calculation of the estimated angle-signal sequence the angle signals are differently weighted, in particular according to the time that has elapsed since the transmitter signals underlying the angle signals were received. When applying the method of the smallest error square the estimation can continuously be further improved by taking new measured values into account. As a result, even when the avalanche victims are far away and their transmitter signal is correspondingly weak, a relatively precise site estimate is rapidly obtained. Furthermore, by appropriately weighting older measured values, or the angle signals derived therefrom, in relation to the current ones a skipping or an excessive instability in the calculated transmitter search angle can be reliably suppressed.

In other embodiments of the method in accordance with the invention, estimated transmitter signals are found by correlating the transmitter signals with preset filter signals, and angle signals are found from the estimated transmitter signals. If a cross-correlation is carried out between the filter signals and the transmitter signals, it is possible to detect weak signals from a transmitter, for example one at a great distance from the search device; this process corresponds to detecting a signal of known form in noise.

In another design of this embodiment, in order to extract the transmitter signal from interfering noise by correlating the received transmitter signals with a sinusoidal and with a cosinusoidal filter-signal sequence, one sinusoidal and one cosinusoidal signal sequence are derived. In principle the above-mentioned cross-correlation can be carried out by means of a matched-filter mechanism. However, the disadvantage of the matched filter consists in the complexity of the calculation. This is caused by the fact that the model function represented by the filter signals must be compared with the sequence of received transmitter signals in all possible phases. This elaborate calculation can be considerably reduced if the sequence of transmitter signals is broken down into a sine and a cosine component.

In another design of this embodiment the received field strengths of the signals in the estimated transmitter-signal sequence are found by summation of the products of the (where appropriate, previously down-mixed) reception signal sequence with a sinusoidal and a cosinusoidal signal sequence. The argument (angle) of the complex number formed by the above-mentioned sine and cosine components describes the phase position of the received signal in relation to the cosine model function, whereas the amount of the complex number is a measure of the received field strength.

In preferred embodiments of the method in accordance with the invention, in order to detect several transmitters a periodic signal component of stored transmitter signals or processing signals, in particular estimated transmitter signals, is found by autocorrelation. If the signals from several avalanche victims are being received, the different transmitter signals can be mutually superimposed and also obliterate one another. Because two transmitters always employ repetition rates and/or clock-pulse relations that differ slightly from one another, however, it is possible in principle to ascribe each of the received signals to one or the other transmitter. When the signals from several transmitters are superimposed, what is produced is the sum of several signals that are periodically switched on and off. Therefore the autocorrelation function is suitable for detecting the periodic components of this summed signal. For example, from the measured reception field strengths it is possible by threshold discrimination to construct an on/off function, the autocorrelation function of which contains spectral lines at the frequencies that are present. This makes it possible to separate the signals from several transmitters. By averaging the autocorrelation function over several observation periods, dominant periodic components can be very reliably detected, relatively independently of the orientation of each of the transmitters with respect to the receiver.

In one design of this embodiment a detected periodic signal component that can be ascribed to a transmitter is blanked out from transmitter signals or processing signals in order to detect other periodic signal components. The periodic components of relatively weak received signals are often obscured by noise and inaccuracies. In order to detect these components, it is advantageous for signal components that can be ascribed to a dominant received signal to be blanked out (set equal to zero).

In other embodiments of the method in accordance with the invention the signals emitted by a transmitter are individualised by a transmitter identification code, to distinguish them from the signals sent by other transmitters, and processing signals are generated that associate a transmitter search angle with this identifier. Thus group functions can be created, so that out of a plurality of transmitters at least one can optionally be identified by its individual identifier, for example the one that belongs to the leader of a group of skiers.

Other aspects, advantages and useful features of the invention will be evident from the following description of an exemplary embodiment of the invention with reference to the enclosed figures, wherein

BRIEF DESCRIPTION OF THE DRAWINGS

In the figures the same reference numerals are used for identical elements and elements with identical actions.

DETAILED DESCRIPTION OF THE PREFERRED EMBODIMENTS

Figure 1:
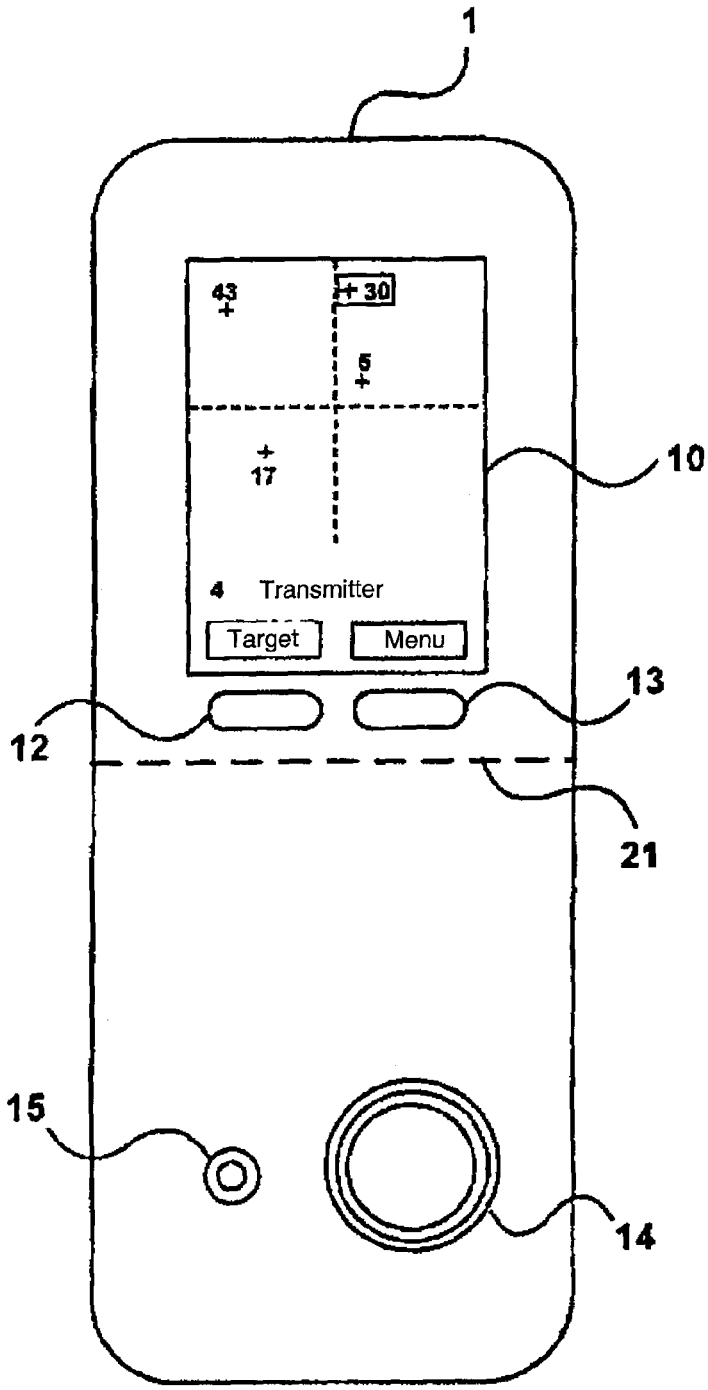
FIG. 1 shows an exemplary embodiment of a search device in accordance with the invention.

FIG. 1 shows an exemplary embodiment of a search device 1 constructed in accordance with the invention, to be used in searching for avalanche victims (hereinafter termed AVS device). Communication with the user is accomplished by way of an illuminated display 10 and two control keys 12, 13. The display 10 allows the position of one or more avalanche victims to be displayed graphically in relation to the user's own site. The device 1 additionally comprises a loudspeaker 14 that enables a synthetically generated search tone to be heard by the user, as acoustic feedback, and a LED 15 such as is known for conventional devices. The speaker 14 and the red LED 15 make it possible also to perform a conventional search, without employing the graphic information shown by the display 10.

Figure 2A:
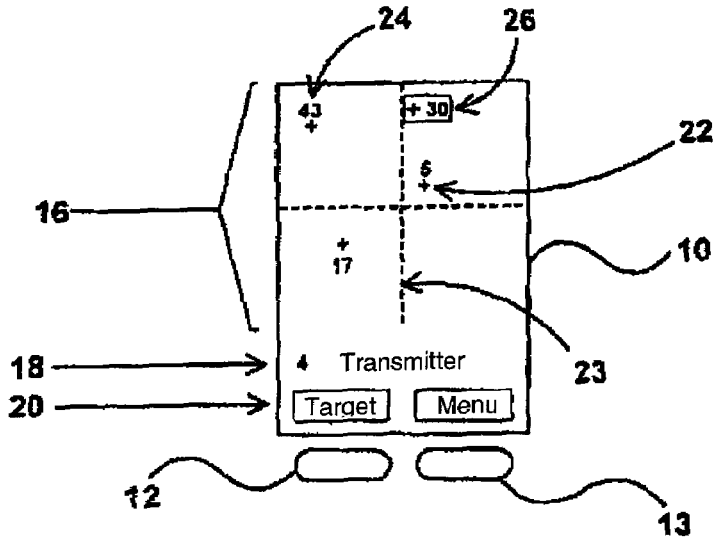
FIGS. 2*a*, 2*b* give different views of the display of the search device according to FIG. 1.

As represented in detail in FIG. 2*a*, the display 10 is subdivided into a coordinate field 16 that displays to scale the position of the located transmitter of an avalanche victim, a status line 18 showing the most important information in each case, and label fields 20 for the two operating keys 12.

The device 1 is designed as a combined search and transmission device. The case is shaped like a foldable mobile telephone. The hinge is indicated in FIG. 1 by a dashed line 21. When the device is in search mode, folding it up automatically switches it back into the transmitter mode. This advantageously implements an emergency switchback, a standard requirement e.g. in case of a subsequent avalanche.

The device 1 is provided with an antenna, not visible from the exterior, for transmitting and searching at a search frequency of 457 kHz. This frequency is the standard for AVS devices (EN 282). An automatic localization of the avalanche victim is brought about by the natural swiveling movement of the searcher, i.e. the device user. However, the invention eliminates the need to take bearings manually, as is required by conventional devices. In addition the illustrated device 1 makes available a targeting mode, for concentrating on one selected person.

A search process thus proceeds as follows. The searcher, having switched from transmission to search operation, swivels the device 1 back and forth a few times through ca. 180 degrees. The direction-finding accuracy is initially about ±10 degrees. During swiveling all the signals sent out by the transmitters of victims who are within range are detected. The range of the device is about 80 m. The transmitters can be conventional AVS devices, or else can be constructed identically to the device 1. Manual direction-finding, by keeping the device 1 pointed in the direction of the strongest signal, is not necessary.

The detected transmitters 22 are represented in terms of direction and distance on the display 10, such that the distance of the transmitter 22 from the searcher (located in the center of the coordinate field 16, i.e. the cross-hairs 23) is indicated precisely to scale by the distance data 24 in meters.

The searcher can now focus on locating the person who should be found first, by actuating the key 12 "TARGET" and thus blanking out the other transmitters 22. During the search procedure distance data 24 and position data 22 are continually adjusted to the current position of the searcher.

The search for a nearby target can be assisted by the red LED 15. Furthermore, for a precise punctuate localization a zoom function in the display 10 can be activated (not shown). As the searcher approaches a transmitter site 22, i.e. the point at which an avalanche victim is thought to be lying, a circle is superimposed on the display 10 that is concentric with the victim's location 22 and becomes concentrically smaller as the searcher comes closer. Experience has shown that it is advantageous for superposition of the circle to begin at distances of about three meters, but it can be superimposed while the distance is greater or only at smaller distances. Instead of a circle, a square or similar symbol could also be used.

The search device in accordance with the invention can be used to find the exact depth of the snow covering the victims, by simple means. The searcher moves until the displayed position of the detected transmitter 22 (the presumed site at which the victim is lying) coincides with the point at which the lines 23 cross (the position of the searcher), which means that the searcher is standing vertically above the victim. The distance indicator 24 then gives the depth of the overlying snow cover. In the case of known search devices the cover depth can be determined only indirectly, and if the cover is very deep these values are unreliable, because the display for deeply buried transmitters often remains the same over a region with a diameter of up to several meters, and it is impossible to obtain any more exact data.

Once a victim has been found and rescued, the searcher cancels the targeting option and devotes himself to the next victim.

The search device 1 is equipped with a movement sensor (not shown), which detects whether the device 1 is being moved. If the device is in any mode other than the transmission mode, and if it is not moved for a period of 90 seconds, switching into the transmission mode occurs automatically. As a result the above-mentioned emergency switchback is reliably initiated even if the searcher has been caught in another avalanche, or because of some other surprising event has not had an opportunity to fold the search device closed.

The search device 1 in the exemplary embodiment described here has other functions in addition to the search function, which can be selected from the main menu called up by the key 13. Among these are an electronic compass, a temperature indication and an inclination measurement for evaluating the danger of an avalanche, as well as a display of the state of the battery with an indication of the time remaining for transmission and searching operation. When the battery is low, a warning is given regardless of the mode of operation.

Although the standard, for reasons of security, in principle allows no supplementary functions (compass, temperature indication, inclination measurement), the search device in accordance with the invention requires, e.g., the inclination sensors for its functionality. In this case all that is needed is to ensure that the display of the additionally obtained data does not increase power consumption to such an extent that the reliability of the device is no longer guaranteed. Therefore a safety circuit is provided in the search device 1 (not shown), which turns off the display of the supplementary functions when the battery capacity falls below 50% of the maximal value. Thus the standard requirements for operating security of the device are fulfilled.

In other search devices in accordance with the invention only a few or none of these supplementary functions are present; hence a safety circuit as described above can also be eliminated.

In addition, by way of the main menu of the search device 1 it is possible to access a brief set of instructions for the device and configuration displays as well as possible configuration settings for speech and display illumination.

By means of the integrated sensors, which are described in greater detail below, the device 1 can determine at any time the direction in which the searcher is momentarily holding it. Thus the position of the located transmitters of the victims can be represented correctly relative to the user's own location at any point in time.

Figure 2B:
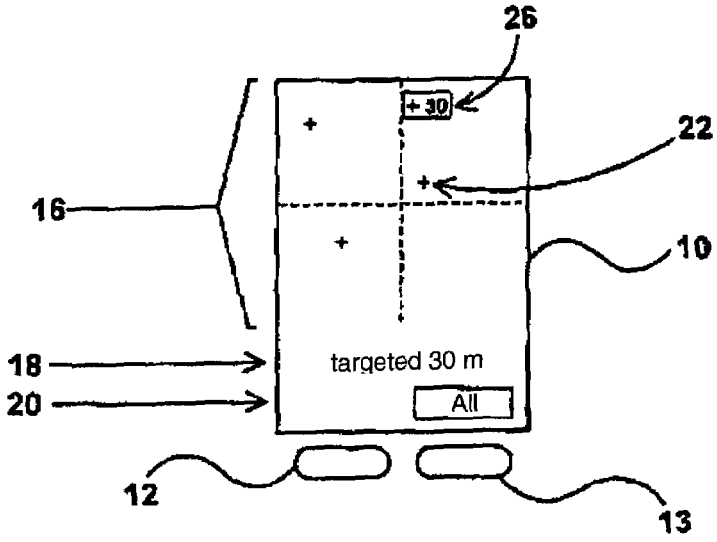

From the display illustrated in FIG. 2*a* it is intuitively clear that the avalanche victim 26, marked by a rectangle in the coordinate field 16, is 30 m away in precisely the direction towards which the device 1 is currently being held. The nearest victim straight ahead—marked as shown—can be selected for further searching by pressing the key 12 ("TARGET"). As shown in FIG. 2*b*, the information in the display 10 is thereby reduced to the data regarding the targeted victim 26. The loudspeaker 14 (cf. FIG. 1) now reproduces only the search tone of the targeted victim 26, in a distance-dependent way. This targeting can be cancelled at any time by actuating the key 13 ("ALL"). A multiple search is possible for up to six victims at a time.

The technical implementation in search device 1 is brought about in principle by digitizing the received 457-kHz signals and processing them with a powerful microprocessor. Algorithms used in the digital signal processing enable search tones, i.e. transmitter signals, to be filtered out of the noise even if they are below the threshold for perception by human hearing. This makes it possible for the range of the device to be comparable to that of conventional, analog devices.

From the received signals the positions of the victims are calculated. The algorithms employed here are robust against single disturbances or measurement errors. Because the positions are continually recalculated over the entire search phase, the accuracy of the estimated positions of the victims rapidly improves with time.

Figure 3:
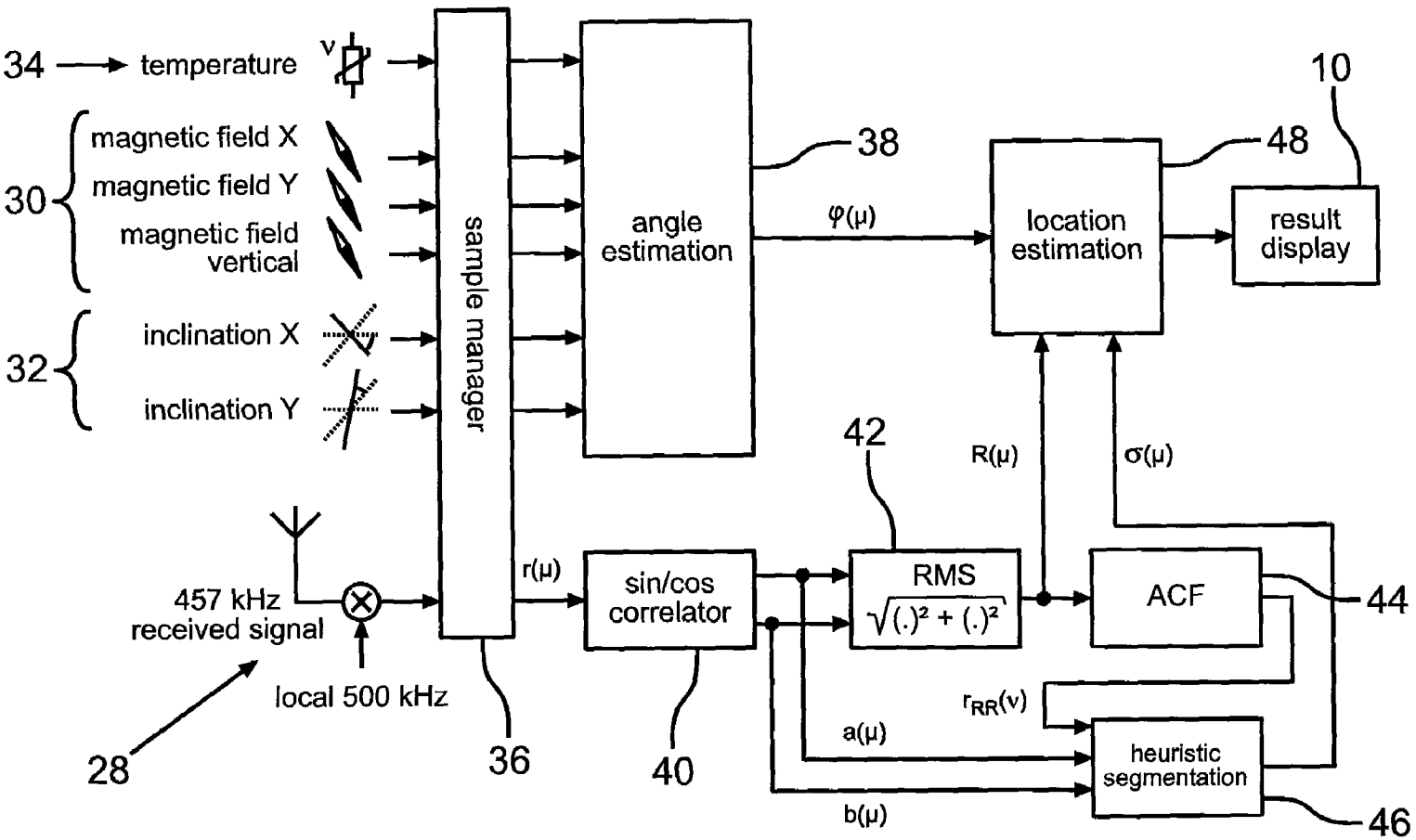
FIG. 3 shows schematically a functional block diagram of the search device in FIG. 1.

In FIG. 3 the functional arrangement of the device 1 shown in FIG. 1 is diagramed. In addition to the receiver 28 with search antenna and mixing stage for the search tone, a sensor 30 for the earth's magnetic field is present, which outputs a sensor signal for each rotational degree of freedom (X, Y, vertical), as well as inclination sensors 32 for the two axes of tilt. In addition the drawing includes another sensor 34 for one of the supplementary functions of the device mentioned above, the temperature measurement.

The microprocessor-controlled sample manager 36 sends the current sampled value to the correct destination and selects the channel for the next sampled value. The temporal behavior is such that substantially the maximal possible sampling rate is made available for sampling the received, i.e. transmitter signals. For sampling the sensor data the received signal is blanked out in about every 32nd time slot, and instead of it one of the sensor channels for temperature, magnetic field and inclination is read in.

In the angle-estimation module 38 the spatial position with respect to the earth's magnetic field is determined exactly from the sampled values provided by the magnetic sensor 30 and the inclination sensors 32. Such procedures are known per se to one skilled in the art, and hence are not further described. By using these sensors 30, 32 in accordance with the invention every direction in which the search device 1 is held is assigned a fixed search angle $\phi$ with respect to the measured magnetic-field vector $\mu$.

The sin/cos correlator 40 is provided for the detection of transmitter signals at the limit of sensitivity. Fundamentally the objective to be achieved is to be able to locate a victim even at the greatest possible distance. This corresponds to detecting a signal of known form in noise.

To find such a search tone in noise is—in the sense of a hypothesis test—optimally achievable with a "matched filter", a process basically involving a cross correlation between the sought and the received signal.

The impulse response of the matched filter is precisely the desired function, reflected along the time axis. The benefit obtained by the matched filter can be ascribed to the fact that useful signal components are constructively added up by the impulse response, whereas interfering signal components are added up according to their power.

The disadvantage of the matched filter is that it involves extensive calculation. This is because the pattern function must be compared with the sequence of received, i.e. transmitter signals in all possible phase positions.

The sequence of transmitter signals is known to be a cosinusoidal signal sequence with constant frequency. Any arbitrarily scaled and phase-shifted sinusoidal oscillation can be decomposed into a cosine and a sine component. The power of the sought signal results as the sum of the powers of the sine and cosine components. Therefore it suffices to multiply the transmitter-signal sequence by a cosinusoidal and a sinusoidal filter-signal sequence—that is, to decompose the sequence of transmitter signals into a sine and a cosine component. The argument (angle) of the complex number formed by the sine and cosine components describes the phase position of the received, i.e. transmitter signal sequence in relation to the cosinusoidal pattern function, whereas the amount of the complex number is a measure of the received field strength.

In terms of system theory, the sin/cos correlator 40 operating in this way brings about a demodulation of the search tone into base band (multiplication by sin and cos) and subsequent low-pass filtering, with suppression of the image frequencies at twice the signal frequency. A substantial advantage of the sin/cos correlator 40 lies in the fact that it can be constructed simply, with a saving of resources. In comparison to a matched filter, the detection performance is worse by 3 dB.

In the RSS module 42 values for "Received Signal Strength" are derived from the initial values a (estimated amplitude of the sine component) and b (estimated amplitude of the cosine component) of the correlator 40, by quadratic averaging. The ACF module 44 then calculates the autocorrelation function (ACF) of the RSS values. The output from the ACF module 44 serves as a basis for separating the signal components when several transmitters are active simultaneously.

The search for avalanche victims becomes especially difficult when the signals from several victims are being received at the same time. The signals from these transmitters can reciprocally overlap and also obliterate one another. Given that two devices always have slightly different repetition rates and/or clock-pulse relationships, it is nevertheless in principle possible for each of the received signals to be assigned to one or the other transmitter.

The superposition of signals from several transmitters amounts to the summation of several signals that are periodically turned on and off. Fundamentally, therefore, an autocorrelation function is a suitable means of recognizing the periodic components of this summed signal.

In the simplest case, from the measured field-strength values an on/off switching function is generated by threshold-value decision, and its autocorrelation function should contain spectral lines at the frequencies present therein. The disadvantage of this procedure is that, especially when the field strengths are low or the receiver antenna is incompletely oriented towards the transmitter, the on/off switching times cannot be specified with sufficient accuracy. Because of this imprecision, the spectral lines in the autocorrelation function are smeared out, i.e. are not sharp, and rapidly become useless.

Just as in the case of ideal on/off switching function, information about periodicity is naturally also present in the analogous field-strength function. This is obtained as a quantity from the output of the sin/cos correlator 40, i.e. as output of the RSS module 42. By averaging the autocorrelation function over several observation periods, dominant periodic components can be specified very reliably and relatively independently of the momentary orientation of the transmitter with respect to the receiver.

The periodic components of fairly weak received signals are often concealed by noise and imprecisions. In order to detect these components, signal elements that can be ascribed to a dominant received signal are blanked out (set to zero).

The association of individual signal segments with different transmitters is undertaken by heuristic segmentation in the segmentation module 46. For this purpose, substantially by threshold-value decisions, those signal elements that contribute to the maximum of the ACF are specified. The signal elements thus found are, where appropriate, further separated by analysis of skips in the correlation values and are assigned to different transmitters. For example, a signal element can be subdivided, starting from the right and left boundaries, into two separate marginal regions and one superposition region in the middle, which is not usable for site estimation. For segmentation, skips and discontinuities in the sine and cosine correlation values can be used.

In the site estimation module 48 the site of the at least one received transmitter is specified. In this procedure the distance of the transmitter can reliably be found by conventional means, applying a power law to the measured or calculated field strength. At the same time, in module 48 the search angle $\phi$ obtained from the sensor data in accordance with the invention is assigned to the processed signals $\sigma$, which indicate the momentary received field strength of a transmitter and are derived from the transmitter signals currently being measured.

The ferrite reception antenna employed in the reception unit 28 has a cosinusoidal directional characteristic. Hence in the case of a motionless transmitter the received field strength changes with the cosine of the doubled search angle. Therefore if the user swivels the device back and forth during the search, thus continually changing the angle, it is a simple procedure to express the field strength a as a function of the search angle $\phi$ in the site estimation module 48.

For all angle signal elements in a recording interval (from which exactly one ACF was calculated), by linking them to the search angles $\phi$ the transmitter search angle and thus the site of the transmitter is estimated. The coordinates found from sequential recording intervals for the same transmitter can be continuously improved by weighted averaging.

Because of the pulsed nature of the search tone, i.e. the received transmitter-signal sequence, the field-strength function, i.e. the sequence of angle signals $\sigma(\phi)$ each of which denotes a received field strength at a search angle, in general is available only in discrete sections. However, the method of smallest error square makes it possible to use these available sections in order to estimate the parameters that the determine the shape of the curve as a whole. From this, it is a simple procedure to calculate the angle and distance of the transmitter.

If there is no interference, it would be possible to calculate the entire field-strength curve from the field strengths in the received transmitter-signal sequence, producing a sequence of estimated angle signals. For this calculation two arbitrary points in the transmitter-signal sequence would suffice. In practice, however, the received signal is more or less contaminated by noise. In this case the two points used for the approximation could accidentally be severely falsified by noise samples, so that the estimated parameters of the actual angle-signal sequence would be very erroneous. To achieve an estimation that is robust against interference, all available points in the received field-strength curve, or the transmitter-signal sequence, should be included and the desired parameters should be optimized so as to minimize the overall deviation of the calculated curve for the estimated angle-signal sequence from the portion of the sequence of angle signals derived from the transmitter signals and search angles.

When the method of smallest error square is applied, the estimation can be continuously improved by drawing upon more recently measured values. On one hand, this enables a rapid, relatively precise site estimation even when the victim is far away and the search or received signal is correspondingly weak. On the other hand, by appropriate weighting of older values in comparison to those currently being measured for the search signals, or calculated for the angle signals, a skipping or excessive instability of the observed transmitter search angle can be reliably suppressed.

By this means, given a sufficient number of measured values, it is possible to determine the position of the transmitter reliably. This applies in particular even when the maximum itself cannot be detected, because the transmitter happens to be in a pause phase at just those times when the searching device is pointing towards it. The data for the real received signal provide reference points for the number of samples needed for an adequately precise specification.

Another task for site estimation is to solve the problem of resolving the 180-degree ambiguity involved in estimating angles from the field-strength differences between two or more consecutive recording intervals, and assigning the transmitter to the half-plane in front of (in the direction of movement) or behind (opposite to the direction of movement) the device.

This solution allows the site of an avalanche victim, in particular the transmitter search angle, to be completely and reliably calculable even if a transmitter has paused transmission at the time when the searcher's device 1 is pointing in its direction. This is achieved with a search device designed in accordance with the invention, which comprises only a single search antenna and hence can be made lighter at a more favorable price (of course, it is also possible to employ more than one antenna in a search device according to the invention).

Once the site of a transmitter has been determined, it is made visible on the display 10 as described above with reference to FIGS. 1, 2*a* and 2*b*.

The functions of the search device in accordance with the invention described here as an example are represented by modules shown as separate units in FIG. 3. These units can be present in the search device in the form of software, firmware and/or hardware. Preferably the modules take the form of software on a microprocessor/DSP. For a fully equipped search device like that shown in the figures, a processor with 30 MIPS calculating performance and 8 kB working storage would be suitable.

Many modifications of the search device described here as an example are conceivable. For instance, a device in accordance with the invention could be constructed without an ACF module or a module for separating the signal components received from several transmitters. Such a device can be used in situations in which only one transmitter needs to be located. An example of this is a group of skiers on a protected piste, where the group leader can be located by the search devices of the other members of the group, while only the leader's transmitter is operating in transmission mode.

Similarly, a search device in accordance with the invention can be constructed without a module to perform the cross-correlation of a filter signal with weak search or received signals. Then the weak signals are no longer detectable in noise, and the sensitivity of the search device is accordingly reduced. However, the resources of the device (available storage space, processing capacity) are available for other functions; for instance, the ACF module can be designed to separate a larger number of transmitters from one another. It is also possible for a device with fewer functions to operate for longer with a given battery capacity, for instance when a smaller processor is used.

It is conceivable for a search device in accordance with the invention to be combined with a GPS system. The GPS system makes available a representation of the terrain that is true to nature. The position of the searcher and the transmitter sites detected by the search device, i.e. the places where the victims are presumed to be lying, are superimposed on the representation provided by the GPS system. Such a system enables the searcher to determine the location of the victim intuitively, and hence rapidly, on the basis of whatever notable landscape features may be present, so that the location can be accessed with the least possible delay.

Alternatively or additionally, the search device can be combined with a vocal control such as is known, e.g., in GPS systems for motor vehicles. In this case the searcher is given audible instructions, for instance in the form of a voice generated by the search device. This allows the searcher to concentrate on looking at the surroundings.

A search device in accordance with the invention can furthermore be combined with a camera, such as is known for mobile telephones. Here it is advantageous for the view of the landscape recorded by the camera to be reproduced on the display of the search device. The detected transmitter locations are superimposed on this landscape view. What is seen on the display is largely consistent with what the searcher sees in his surroundings. This facilitates orientation of the searcher, in particular in terrain with complicated contours.

It is also possible to combine a search device in accordance with the invention with both a GPS system and a camera. Here the GPS system and camera cooperate to generate a detailed and highly contoured representation of the terrain.

Instead of serving only to find people caught in avalanches, a search device in accordance with the invention can also be advantageously employed for other purposes. As an example, consider a group of skiers who are orienting themselves by their group leader when, for example, the view is obscured or other circumstances interfere with this orientation. The leader's device possesses a transmitter, the signal from which is provided with an individual identification code. The search devices of the members of the group are designed to evaluate the received transmitter identifier, so that the located transmitter of the leader is identifiable among the larger number of located transmitters. The display on the search devices of the participants specifies the site of the group leader by showing the identifier. In a further development of this method all transmitters of a group can be individualised by transmitter identifiers.

Although no provision is made for transmitter identification by way of the standardized signal at 457 kHz, a transmission device can comprise, in addition to the transmitter that conforms to the standard, a second transmitter that sends out the signals with transmitter identification codes.

Additionally within the scope of the invention, which is indicated exclusively by the following claims, are many other embodiments that can conceivably be produced by the actions of a person skilled in the art.

LIST OF REFERENCE NUMERALS

1 Search device
10 Display
12, 13 Operating keys
14 Loudspeaker
15 Led
16 Coordinate field
18 Status line
20 Label field for operating keys
21 Folding hinge
22 Symbols for detected transmitters in the coordinate field 16
23 Cross-hairs
24 Distance data in the coordinate field 16
26 Located transmitter highlighted in display
28 Receiver with search antenna
30 Sensor for the earth's magnetic field
32 Inclination sensors
34 Temperature sensor
36 Sample manager
38 Angle-estimation module
40 Sin/cos correlator
42 RSS module
44 ACF module
46 Segmentation module for heuristic segmentation
48 Site-estimation module
a Estimated amplitude value of the cosine component
b Estimated amplitude value of the sine component
r Received signal, i.e. transmitter signal
r Output signal from the RSS module
μ Magnetic-field vector
ϕ Search angle
σ Calculated reception field strength of a transmitter

The invention claimed is:

1. A portable search device that locates a transmitter, the search device comprising:

a search antenna that receives a transmitter signal sent out by a transmitter from a momentary search direction;

a magnetic field sensor that detects magnetic field signals related to the earth's magnetic field;

a signal processor that assigns to each received transmitter signal a fixed search angle relative to the magnetic field signals and also generates an angle signal from the transmitter signals relative to the magnetic field signals, the angle signal representative of a reception field strength assigned to the search angle; and an output unit in communication with the signal processor that receives the angle signal from the signal processor, the output unit configured to generate result signals representative of the angle signal.

2. The portable search device according to claim 1, wherein the magnetic-field sensor sends to the signal processor three sensor signals related to the earth's magnetic field.

3. The portable search device according to claim 1, further comprising inclination sensors that send to the signal processor sensor signals representing the orientation of the search device with respect to a horizontal plane.

4. The portable search device according to claim 1, wherein the signal processor is further configured to calculate a transmitter search angle at which the transmitter is located, with reference to the angle signals.

5. The portable search device according to claim 4, wherein the signal processor is further configured to derive the transmitter search angle from at least two angle signals.

6. The portable search device according to claim 4, wherein the output unit further comprises a display field that displays a graphic output of result signals representing the transmitter search angle.

7. The portable search device according to claim 6, further comprising a GPS system and/or a camera to represent the surroundings on the display field.

8. The portable search device according to claim 1, wherein the signal processor comprises a filter correlation unit that detects angle signals by correlating the transmitter signals with preset filter signals.

9. The portable search device according to claim 8, wherein the filter correlation unit correlates the transmitter signals with a sinusoidal and with a cosinusoidal filter-signal sequence.

10. The portable search device according to claim 1, wherein the signal processor comprises an autocorrelation unit that autocorrelates periodic signal components in stored signals.

11. The portable search device according to claim 10, wherein the autocorrelation unit is positioned in the circuit after a filter correlation unit.

12. The portable search device according to claim 1, wherein the search antenna comprises a ferrite antenna with cosinusoidal directional characteristic.

13. The portable search device according to claim 1, wherein the signal processor is configured to individualize transmitter signals based on transmitter identification codes to distinguish between a plurality of transmitters.

14. The portable search device according to claim 1, wherein the signal processor is configured to individualize transmitter signals and generate processed signals that assign a transmitter identifier to a transmitter search angle.

15. The device of claim 1, wherein the antenna is configured to be swiveled.

16. The device of claim 1, wherein the device is handheld.

17. A method for localizing a transmitter comprising:

positioning a search device at a plurality of search angles;

receiving transmitter signals from a transmitter at a momentary search direction using an antenna operatively connected to the search device;

receiving magnetic field signal representative of the earth's magnetic field;

generating processed signals based on the transmitter signals relative to the magnetic field signals, the processed signals including at least one angle signal representing a reception field strength assigned to a search angle; and generating an output signal representative of the processed signals and displaying the output signal to a user.

18. The method according to claim 17, further comprising measuring field strength components of the earth's magnetic field in three mutually perpendicular directions.

19. The method according to claim 17, further comprising detecting inclinations of a search device with respect to a horizontal plane.

20. The method according to claim 19, the method further including calculating an estimated angle-signal sequence from the angle signal by an estimated angle-signal sequence involving the method of smallest error squares, and the search angle is specified from the maximum of the estimated angle-signal sequence.

21. The method according to claim 20, the method further comprising weighting the angle signals differently in the estimated angle-signal sequence according to the time that has elapsed since reception of the transmitter signals on which the angle signals are based.

22. The method according to claim 17, further comprising generating angle signals representative of reception field strength and the search angle.

23. The method according to claim 17, wherein the search angle is determined by at least two angle signals.

24. The method according to claim 17, further comprising deriving estimated transmitter signals by correlation of transmitter signals with prespecified filter signals, and deriving angle signals from the estimated transmitter signals.

25. The method according to claim 24, the method further comprising deriving one sine and one cosine signal sequence to distinguish the transmitter signal from noise interference by correlation of received transmitter signals with a sinusoidal and with a cosinusoidal filter-signal sequence.

26. The method according to claim 25, the method further comprising reception field strengths of the signals in the estimated transmitter-signal sequence by summation of the products of the received transmitter-signal sequence with a sine and a cosine signal sequence.

27. The method according to claim 17, the method further comprising using autocorrelation to find a periodic signal component of stored transmitter signals or processed signals.

28. The method according to claim 27, the method further comprising blanking out a detected periodic signal component assigned to a transmitter from a transmitter signal or processed signal in order to detect other periodic signal components.

29. The method according to claim 17, the method further comprising individualizing transmitter signals by a transmitter identification code distinguishing the transmitter signals from the signals sent by other transmitters, and generating processed signals assigning the transmitter identification code to a transmitter search angle.

30. Search device for locating a transmitter, in particular avalanche-victim search device, wherein for scanning a search area the search device is swiveled by a user through a range of search angles that covers the region to be searched, with a search antenna to receive signals being sent out by a transmitter from momentary search directions, a signal-processing means to generate processed signals from the transmitter signals, and an output unit to which the processed signals are sent and which sends to the user result signals that represent the processed signals, wherein a magnetic-field sensor that outputs to the signal-processing means sensor signals regarding the earth's magnetic field, which are sent on as processed signals to the output unit and assign to each search direction a fixed search angle ($\phi$) relative to the earth's magnetic field ($\mu$), wherein the signal-processing means is designed to calculate a transmitter search angle at which the transmitter is located, with reference to the angle signals.

31. The search device of claim 30 further comprising signal-processing means configured to derive the transmitter search angle from at least two angle signals.

32. The search device of claim 30, wherein the output unit is a display field configured to display graphic output of result signals that represent the transmitter search angle.

33. The search device of claim 32, further comprising a GPS system and/or a camera to represent the surroundings on the display field.

34. The search device of claim 30, further comprising a filter correlation unit for the signal-processing means configured to detect angle signals by correlating the transmitter signals with preset filter signals and to correlate the transmitter signals with a sinusoidal and with a cosinusoidal filter-signal sequence.

35. The method of claim 34, the method further comprising determining the transmitter search angle by at least two angle signals.

36. The method of claim 34, the method further comprising measuring inclinations of the search device with respect to the horizontal plane and correcting sensor signals based on the inclinations, calculating an estimated angle-signal sequence from the angle signals by the method of smallest error squares, and specifying a transmitter search angle from the maximum of the estimated angle-signal sequence.

37. The method of claim 36 further comprising deriving reception field strengths of the signals in the estimated transmitter-signal sequence by summation of the products of the received transmitter-signal sequence with a sine and a cosine signal sequence.

38. The method of claim 34, the method further comprising deriving estimated transmitter signals by correlation of transmitter signals (r) with prespecified filter signals, deriving angle signals from the estimated transmitter signals, and correlating received transmitter signals (r) with a sinusoidal and a cosinusoidal filter-interference sequence, wherein in each case one sine and one cosine signal sequence is derived.

39. Method of localizing a transmitter, in particular the transmitter of an avalanche victim, wherein to scan a search region a search device is swiveled by a user through a range of search angles that covers the search region;

transmitter signals sent out by the transmitter are received from momentary search directions by a search antenna of the search device;

processed signals are generated from the transmitter signals; and result signals that represent the processed signals are output to the user;

wherein sensor signals related to the earth's magnetic field are displayed to the users as processed signals by way of result signals, and to each search direction there is assigned a fixed search angle ($\phi$) relative to the earth's magnetic field ($\mu$);

wherein angle signals, each of which indicates a reception field strength ($\sigma$) at a search angle($\phi$), are generated from the transmitter signals (r) and the associations of search direction and angle; and wherein a transmitter search angle, at which the transmitter is situated, is calculated with reference to the angle signals and a result signal is sent out that represents the transmitter search angle.

40. The method of claim 39, the method further comprising weighing the angle signals differently according to the time that has elapsed since reception of the transmitter signals on which the angle signals are based.

* * * * *